US006958952B2

(12) United States Patent
Gabathuler et al.

(10) Patent No.: US 6,958,952 B2
(45) Date of Patent: Oct. 25, 2005

(54) METHOD FOR FORMING A DATE INDICATOR ACTUATED BY A CLOCK MOVEMENT AND MECHANISM FOR IMPLEMENTING THIS METHOD

(75) Inventors: Jacques Gabathuler, Conches (CH); Cédric Jacot, Morges (CH)

(73) Assignee: Rolex SA, Geneva (CH)

( * ) Notice: Subject to any disclaimer, the term of this patent is extended or adjusted under 35 U.S.C. 154(b) by 419 days.

(21) Appl. No.: 10/295,485

(22) Filed: Nov. 15, 2002

(65) Prior Publication Data

US 2003/0103417 A1 Jun. 5, 2003

(30) Foreign Application Priority Data

Nov. 30, 2001 (EP) ..... 01811166

(51) Int. Cl.[7] ..... G04B 19/24
(52) U.S. Cl. ..... 368/28; 368/34; 368/35
(58) Field of Search ..... 368/28, 34–39

(56) References Cited

U.S. PATENT DOCUMENTS 3,779,001 A * 12/1973 Kocher et al. ..... 368/38
4,257,113 A * 3/1981 Meister et al. ..... 368/35
6,081,483 A * 6/2000 Capt et al. ..... 368/28
6,574,167 B2 * 6/2003 Weissbach et al. ..... 368/35
6,711,100 B2 * 3/2004 Rochat et al. ..... 368/35
6,735,151 B2 * 5/2004 Triponez ..... 368/28
6,738,316 B2 * 5/2004 Gabathuler et al. ..... 368/28
6,744,696 B2 * 6/2004 Vernay et al. ..... 368/37
2003/0193840 A1 * 10/2003 Huter ..... 368/37

FOREIGN PATENT DOCUMENTS

DE 1523777 7/1969
DE 10017589 10/2001

* cited by examiner

*Primary Examiner*—Kamand Cuneo
*Assistant Examiner*—Jeanne-Marguerite Goodwin
(74) *Attorney, Agent, or Firm*—Sturm & Fix LLP

(57) ABSTRACT

According to this method the units and tens numerals are placed onto respective indicator runners (1, 2). Two drivelines are formed, one being a daily driveline between the clock movement and the indicator runners, for moving the units indicator runner (1) selectively step by step by one step every 24 hours, and for moving the tens indicator runner (2) by one step for every ten steps of the units indicator runner (1), in order to move on from one multiple of ten to the next, and for moving the tens indicator alone by one step to move on from "31" to "01" on a 31-day cycle, and an annual driveline between the clock movement and the tens indicator runner, which driveline is programmed to move the tens indicator runner (2) by one step at the same time as the units indicator runner (1) is moved by the daily driveline, to move on from "30" to "01" at the end of the months which comprise less than 31 days.

8 Claims, 12 Drawing Sheets

METHOD FOR FORMING A DATE INDICATOR ACTUATED BY A CLOCK MOVEMENT AND MECHANISM FOR IMPLEMENTING THIS METHOD

The present invention relates to a method for forming a date indicator actuated by a clock movement to show, in succession and automatically, all the days from 01.03 of one year to 28 or 29.02 of the next year, and to a mechanism for implementing this method.

Date mechanisms for timepieces can be classified according to two types as far as the display is concerned; those which have a graduation bearing, in succession, the numerals of the thirty-one days of the longest months and those which bear the tens numerals and the units numerals on two separate display runners. This second type of display is generally used to allow larger numerals to be displayed than when there are thirty-one days on one and the same display runner, the height of these displays being necessarily restricted by an angle corresponding to $1/31^{st}$ of the length of the circumference on which the days are arranged.

There are various types of mechanism of differing levels of complication used in conjunction with the second type of display. One of the problems encountered with the type with two display runners is that of correcting the date at the end of the month.

Of the solutions proposed in an attempt to solve this problem, mention may be made, for example, of CH 689601, which relates to a solution which, to avoid lengthy correction, proposes placing the numeral "1" twice in succession at the end of the month on the units disk so that the first "1" is associated with the "3" of the tens disk and the second "1" is associated with the "0" of the tens disk. As a result, correction between the "30" and the "1" entails only driving the date mechanism through one additional step. By contrast, the units disk has to bear three series of ten numerals, plus the additional "1", greatly reducing the maximum size of the numerals, which means that the advantage of the display with two separate runners is considerably lessened.

Another solution has been proposed in CH 310559, in which the date mechanism comprises a wheel with 31 teeth which is driven by one step per day and secured to a wheel with thirty teeth plus a space corresponding to the thirty-first tooth. This wheel meshes with a ten-tooth pinion bearing the units numerals, so that for each revolution of the thirty-toothed wheel, the free space faces the units pinion which remains stationary, thus allowing the numeral "1" to be displayed two days in succession at the end of each month.

The main disadvantage with this mechanism lies in the fact that it makes it possible to have either both the units and the tens disks side by side, or to have them superposed. In the former case, two windows are needed to conceal the space formed between the edges of the disks, and in the latter incidence, the two date numerals are at different levels, and this is not attractive and impedes reading.

This disadvantage was overcome in CH 688671, by transposing the mechanism with thirty teeth and a space in the place of the thirty-first tooth onto a display having two concentric disks. The thirty-one-tooth drive wheel of this mechanism still occupies a very large surface area. JP 51-34748 relates to a date mechanism with two display runners for the units and the tens and which is actuated by a system of cams and levers making it possible for thirty-day months and thirty-one-day months to alternate without any correction. Such a mechanism does, however, have a major disadvantage because two thirty-one-day months follow one another each year, which means that a day in August and a day in January will be missing. Now, given that the normal cycle of this mechanism is sixty-one days (one 30-day month plus one 31-day month), a correction of 31 steps will be needed twice a year in order to regain the "31" missing at the end of January and at the end of August. This being the case, it is undoubtedly preferable to carry out five corrections of one day (or even of two or three days at the end of February) per year than to have only three corrections as in the aforementioned mechanism, but two of which are of 31 days each.

Many other mechanisms associated with separate display members for the units numerals and those of the tens exist. By contrast, none of these solutions has demonstrated a potential advantage that such a display mode has in making it possible in a simple way to produce an annual date in which only one correction per year is needed.

The object of the present invention is to afford a solution that makes it possible to produce a simple and reliable annual date.

To this end, the subject of the present invention first of all is a method for forming a date indicator actuated by a clock movement to show, in succession and automatically, all the days from 01.03 of one year to 28 or 29.02 of the next year, as claimed in claim 1. Another subject of this invention is a date mechanism for the implementation of this method, as claimed in claim 2.

The essential advantage of this method lies in the fact that by arranging the units numerals and the tens numerals on two separate display runners, it then becomes possible for all the dates from 01.03 to 28 or 29.02 of the next year to be displayed in succession and automatically, and therefore without any correction, while selectively moving the display runners of the units and of the tens by just one step per day.

Thanks to this particular feature of this method, a conventional date mechanism requiring five corrections per year can be converted into an annual date mechanism now requiring only one, simply by adding a single annual wheel. This mechanism comprises neither lever nor spring-tensioning cam intended to store up energy for driving date disks as is frequently found when this disk has to be advanced selectively by more than one step when, for example, moving on from the "30" to the "01" of the next month, in the case of thirty-day months.

Other advantages will become apparent in the course of the description which will follow. The drawings appended to this description illustrate, schematically and by way of example, one embodiment of a basic date mechanism and an adaptation of this date mechanism to allow implementation of the method that is the subject of the present invention.

Figure 1:
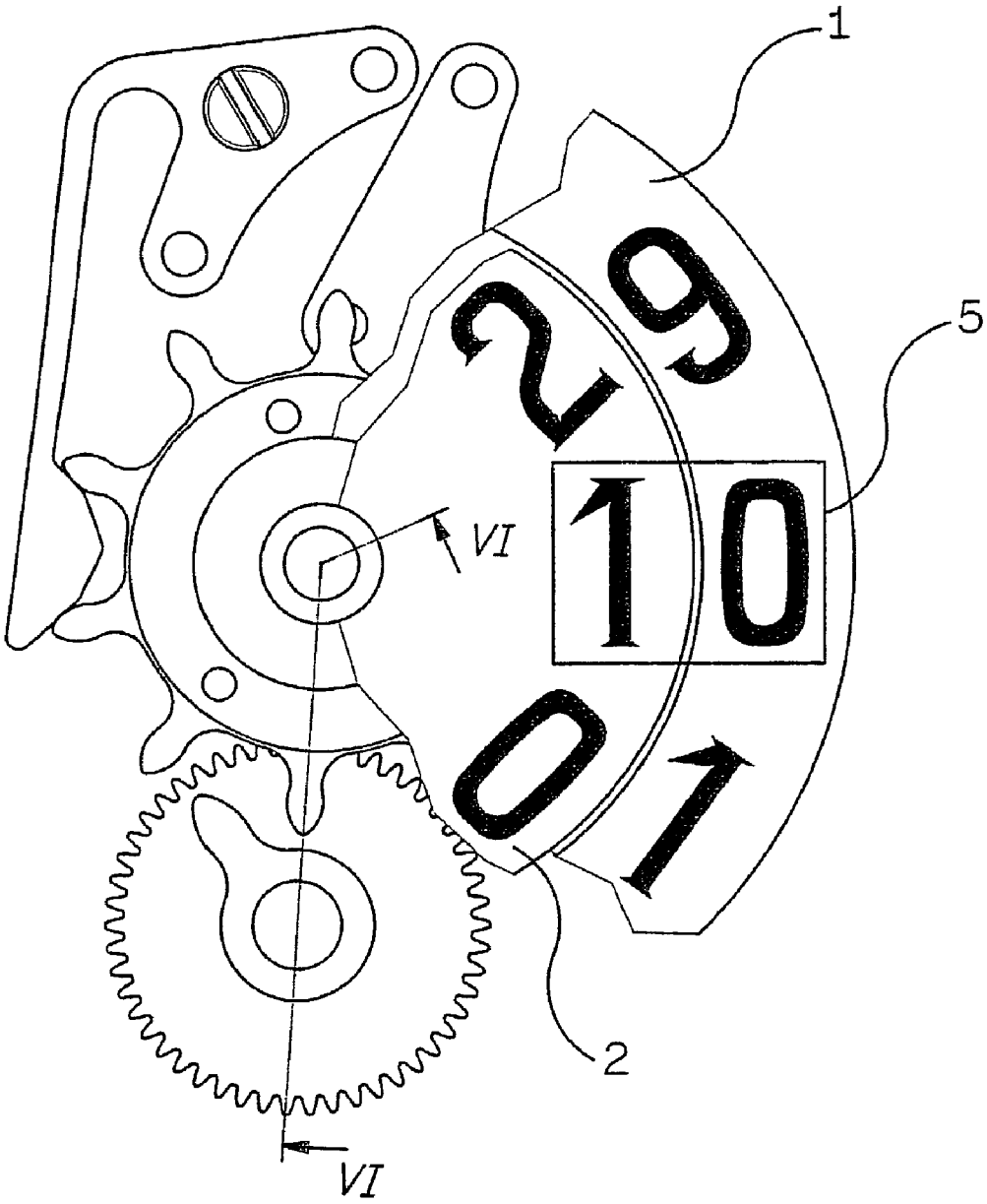
FIG. 1 is a view from above of this basic mechanism with partial cut away of the units and tens disks.

The date mechanism illustrated by FIG. 1 comprises two disks, a units disk 1 bearing ten numerals or a multiple of ten numerals intended to display the units, a tens disk 2 bearing four numerals or a multiple of four numerals intended to display the tens. The numeral "0" on the tens disk 2 may be omitted and replaced by a blank space. The two disks 1 and 2 are concentric and allow the units and tens numerals to be displayed through a single window 5.

Figure 2:
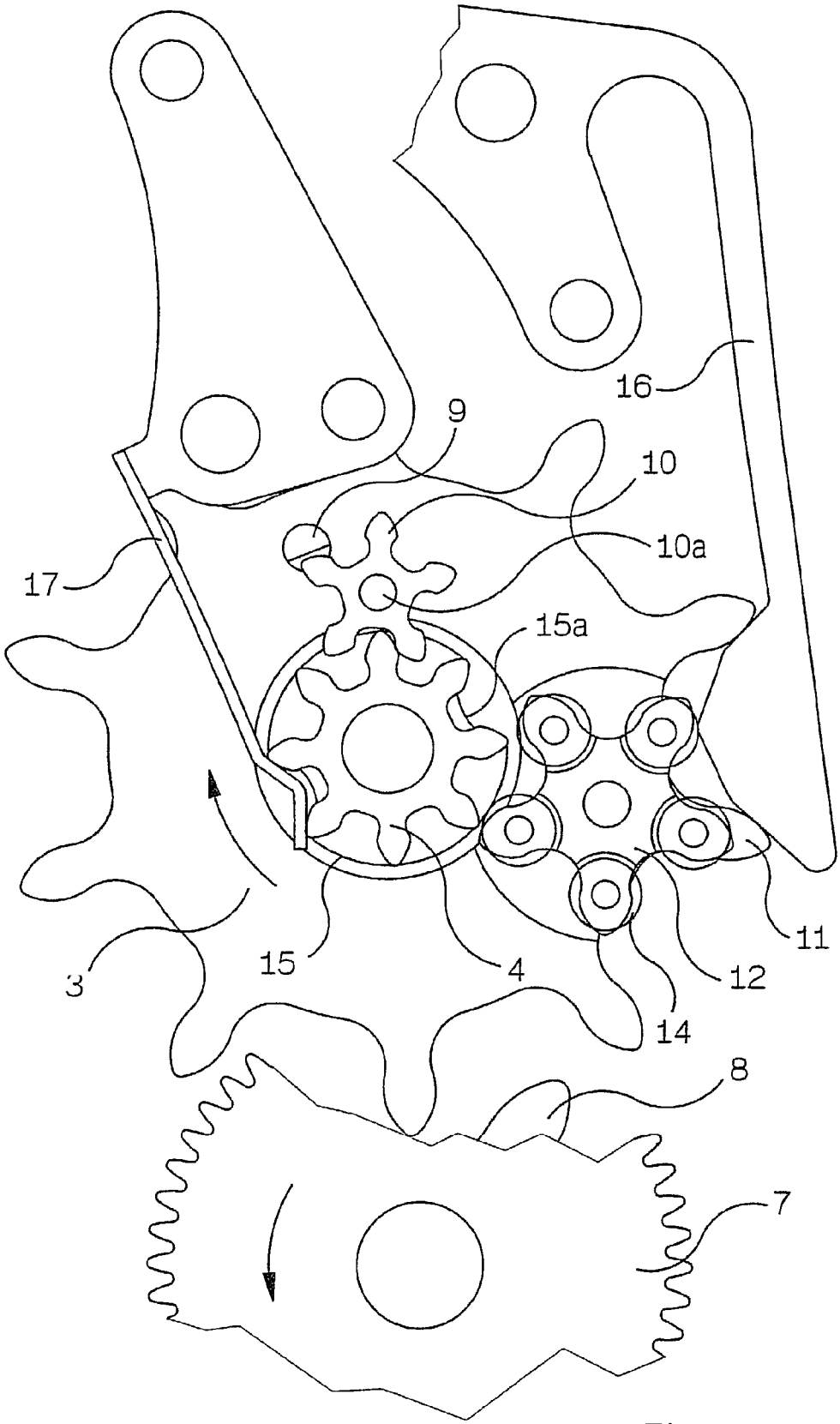
FIG. 2 is a view from beneath of FIG. 1 showing the mechanism when it displays "29"
Figure 6:
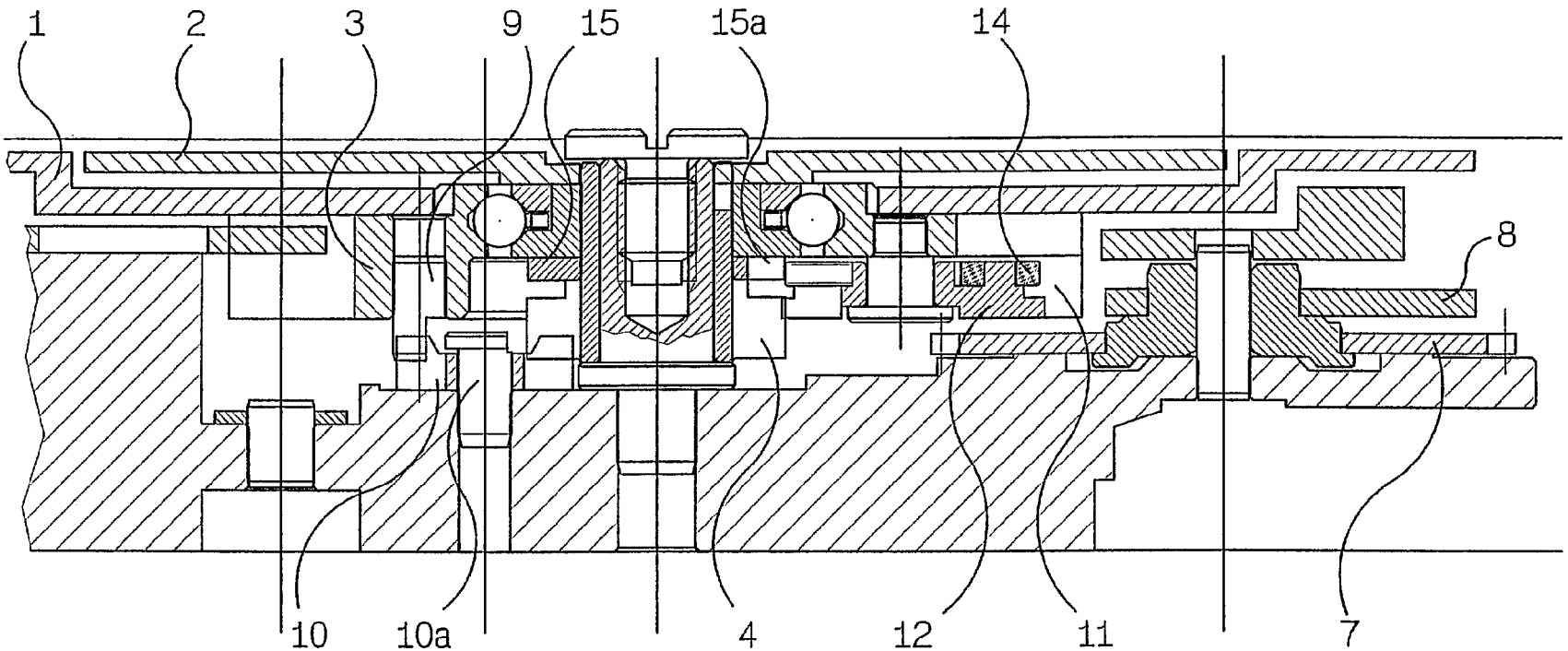
FIG. 6 is a view in section on VI—VI of FIG. 1.
Figure 7:
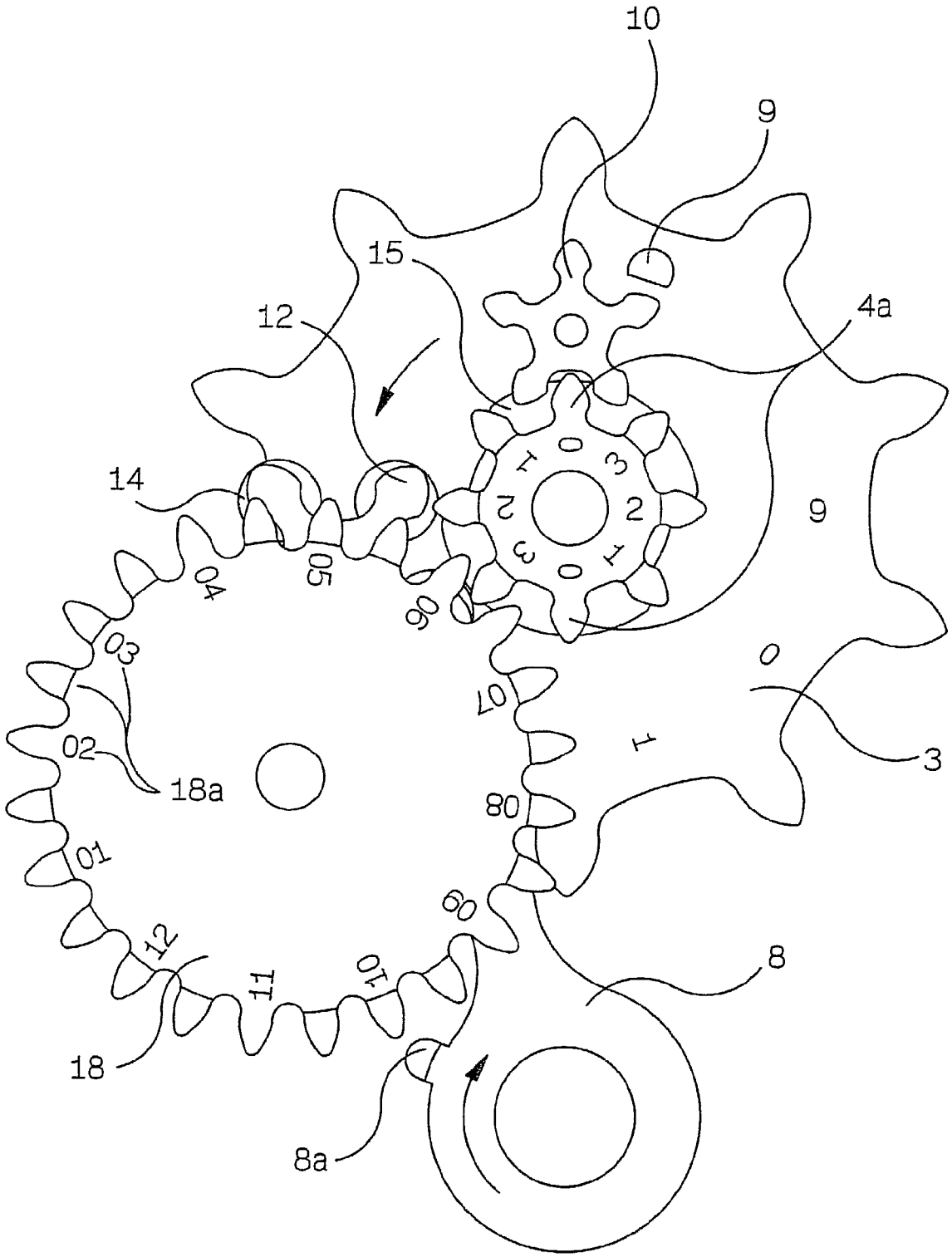
FIGS. 7 to 10 are views of the adaptation of the basic date mechanism of FIGS. 1 to 6 to implement the method and illustrating the positions of the runners of a mechanism for implementing this method during the successive moving-on of the dates ranging from "29" to "01" in a thirty-one-day month.
Figure 8:
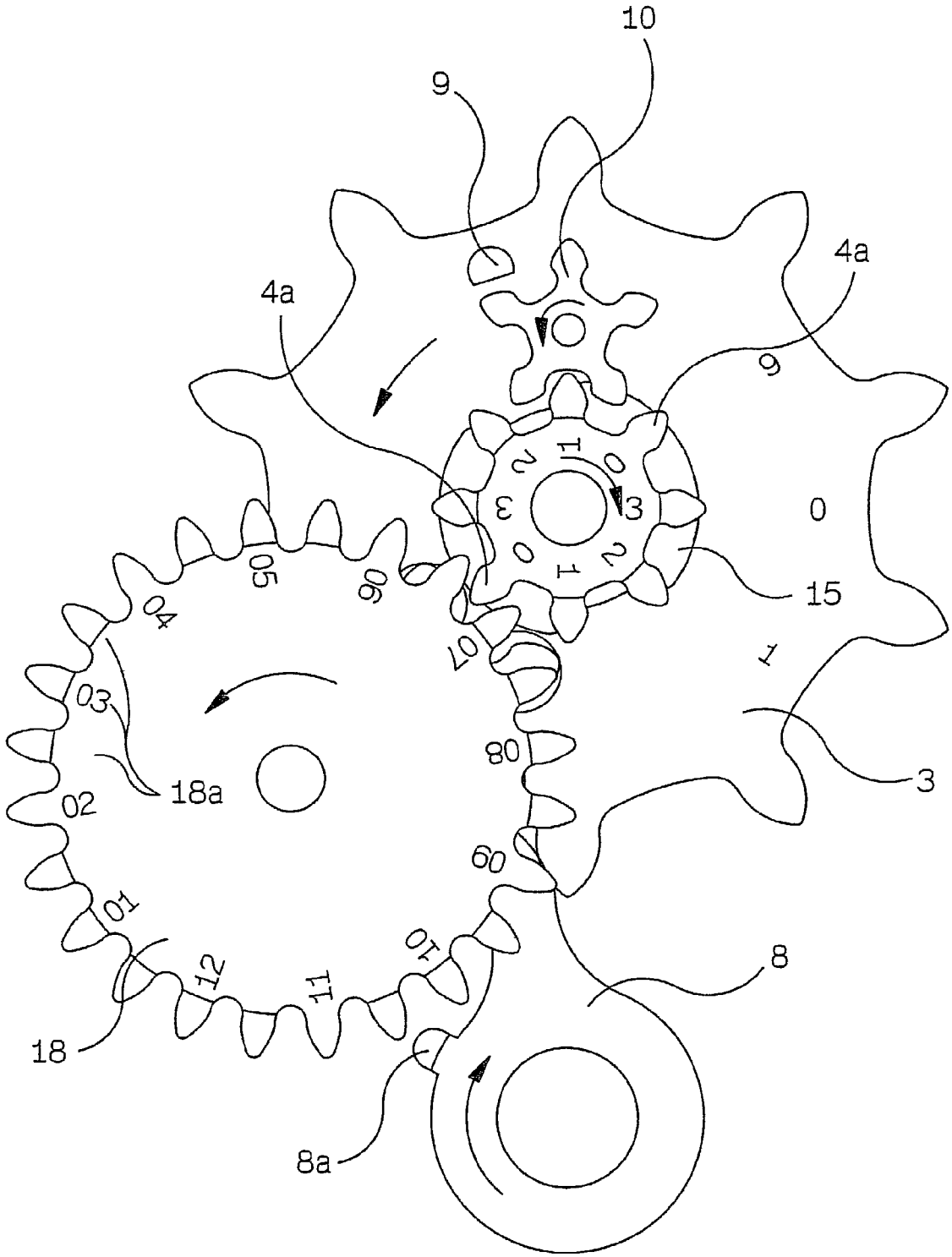
Figure 9:
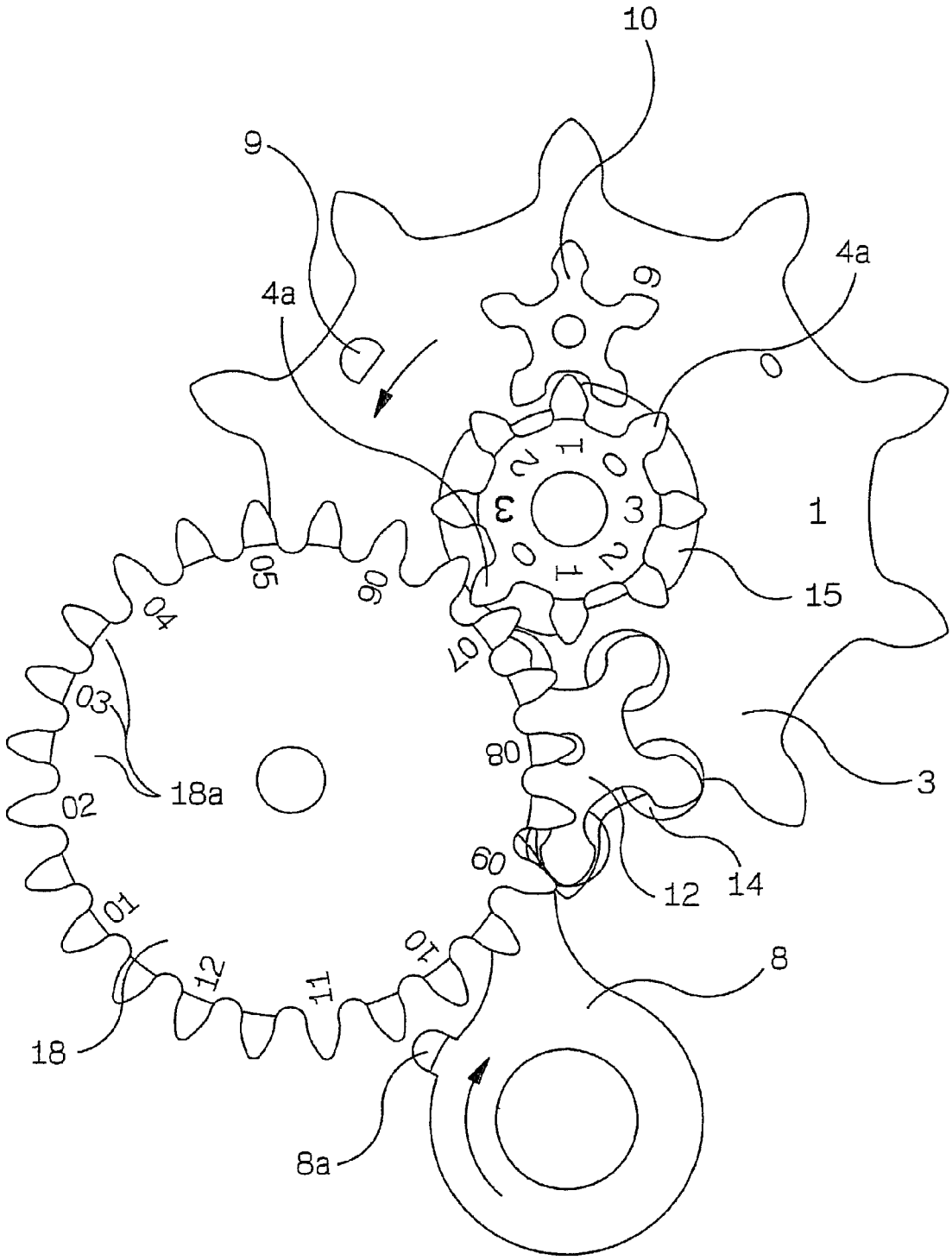

The units disk 1 is secured to a units toothed wheel 3 which has 10 teeth or a multiple of ten. The tens disk 2 is secured to a tens pinion 4 (FIG. 2) which has four teeth or a multiple of four. The tens pinion 4 and the units wheel 3 are concentric, the pinion 4 being partially housed in a circular cutout formed at the center of the units wheel 3. The surfaces of the two disks 1, 2 bearing the date numerals are coplanar, as can be appreciated from FIG. 6.

The units wheel 3 is connected to the hours wheel of the time indicator geartrain (not depicted) which performs two revolutions in 24 hours via an intermediate wheel which drives a calendar wheel 7 at a rate of one revolution in 24 hours. This calendar wheel 7 bears a date finger 8 which drives the units wheel 3 by one step every 24 hours.

An intermediate wheel 10 borne by a tenon 10*a* secured to the mounting plate of the timepiece meshes with the tens pinion 4. This intermediate wheel 10 lies in the path of a pin 9 borne by the units wheel 3, so that the intermediate wheel 10 is driven by one step for every revolution of the units wheel 3 and itself drives the tens pinion 4, also by one step. The driving of the tens pinion 4 coincides with the moving of the units disk 1 from "9" to "0".

In order to avoid having to carry out substantial correction after the "31", by passing step by step through "32", "33" and so on until "01" is rearrived at, the units wheel 3 bears an auxiliary runner consisting of a month-end pinion 12, one tooth of which is positioned by a cam 15 secured to the tens pinion 4 in the place of a hollowed-out tooth 11 of the units wheel 3. Each tooth of the month-end pinion 12 is associated with a dual-pivoting roller 14. These rollers 14 lie at the height of the cam 15, so that these rollers 14 roll along the cam 15, thus reducing friction between this cam 15 and the month-end pinion 12 to a minimum.

The cam 15 has a cut-out 15*a* situated between two teeth of the tens pinion 4, corresponding to the movement from the numeral "3" to the numeral "0" on the tens disk 2. By virtue of this cam 15 and of its cutout 15*a*, the month-end pinion is angularly immobilized with respect to the units wheel 3 when the tens numerals change as long as a portion of cam 15 intersects the part of a roller 14, something which occurs during the tens changes, except during the change from the "31" to "01", which corresponds to the recess 15*a* in the cam 15, which means that in this case, the month-end pinion 12 can rotate by one step, the units wheel 3 remaining immobile. In consequence, the tens disk moves on from "3" to "0", while the units disk remains on the numeral "1", which corresponds to the units numeral for the dates "31" and "01".

Figure 3:
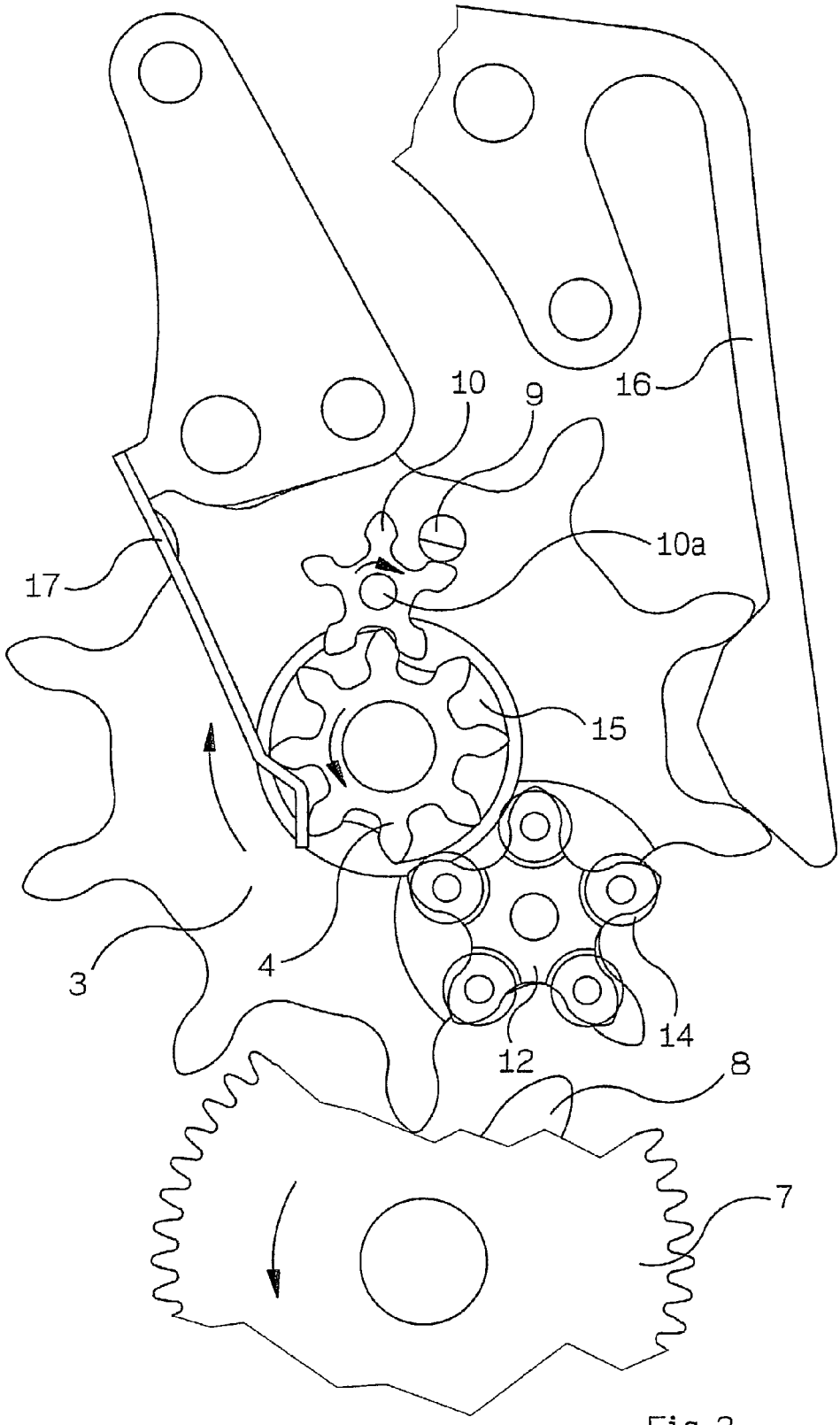
FIG. 3 is a view similar to FIG. 2 at the end of the moving-on to "30"

Two positioning jumpers 16 and 17 collaborate one with the units wheel 3 and the other with the tens pinion 4. As can be seen from the figures, the jumper 16 of the units wheel 3, which is thicker, can develop a higher torque than the jumper 17. This allows the units wheel 3 to be held immobile when the tens disk moves on from "3" to "0" between the "31" and the "01". FIG. 3 shows the date mechanism when the units 1 and tens 2 disks display "30", that is to say that the pin 9 secured to the units wheel 3 rotating in the direction of the arrow situated on this wheel 3 has just caused the intermediate wheel 10 and the tens pinion 4 to advance by one step in the direction of their respective arrows, to move on from the position of FIG. 2 of that of FIG. 3.

Figure 4:
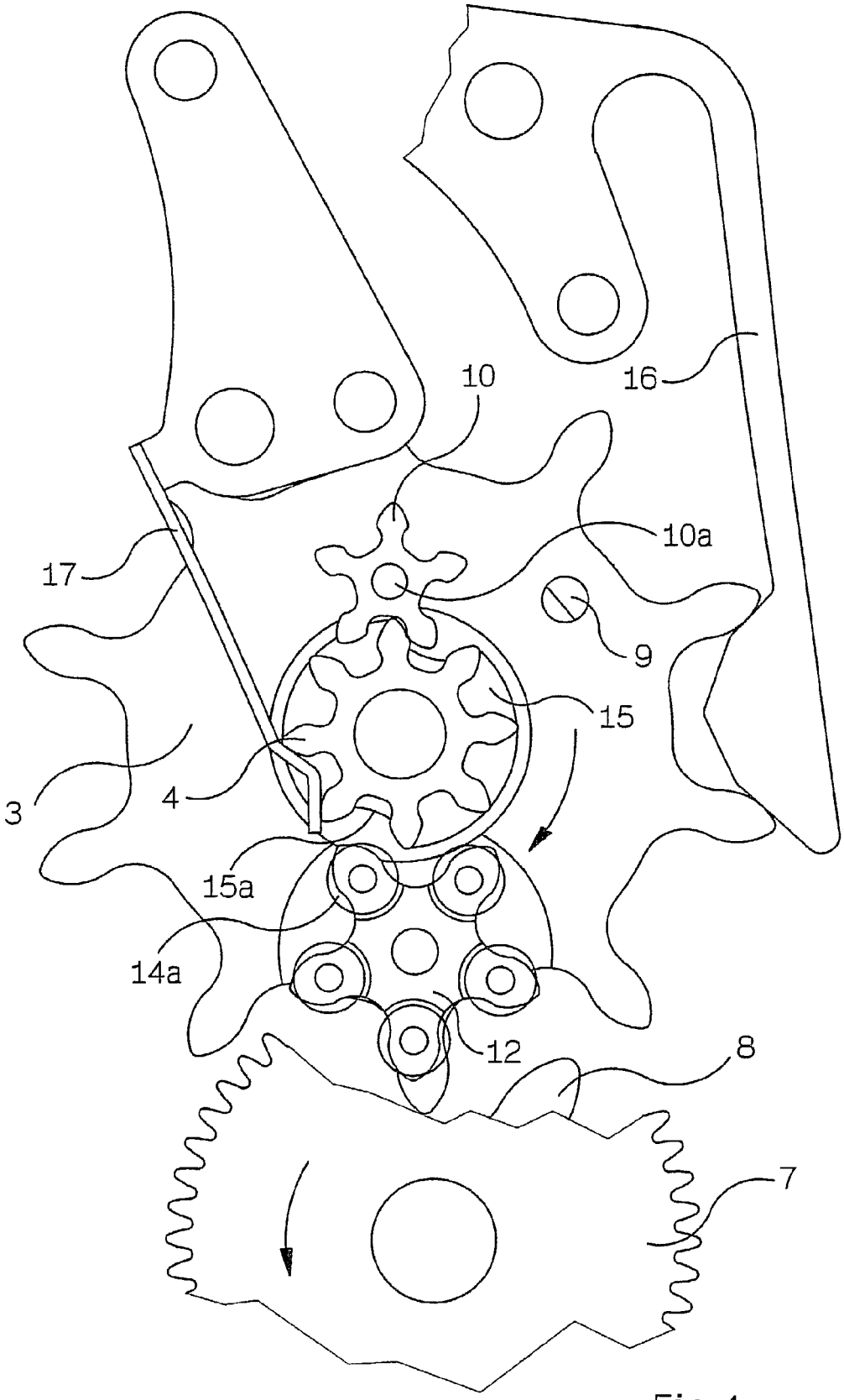
FIG. 4 is a view similar to FIG. 2 at the end of the moving-on to "31"
Figure 5:
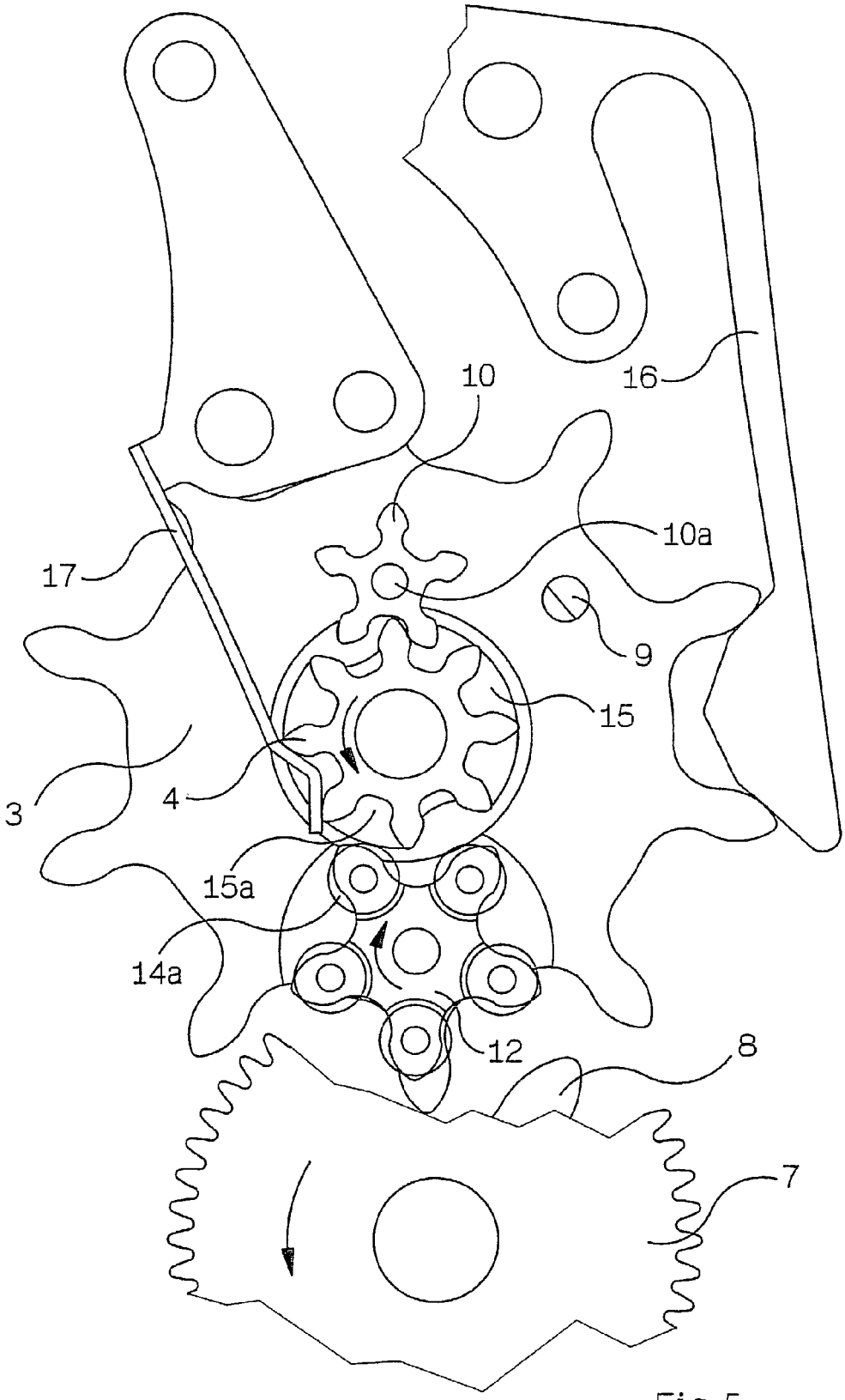
FIG. 5 is a view similar to FIG. 2 at the end of the moving-on to "01"

FIG. 4 shows the position of the runners of the date mechanism when the two disks 1, 2 are displaying "31". It may be seen that, in this position, a roller 14*a* of the month-end pinion 12 faces the recess 15*a* of the cam 15. Thus, in moving on from the position of FIG. 4 to that of FIG. 5, the date finger 8 can then rotate the month-end pinion 12 by one step. As this pinion is no longer immobilized by the cam 15, the units wheel 3 therefore remains immobile. By virtue of this month-end pinion and of the cam 15, the date can be moved on directly from "31" to "01".

As can be seen, whereas hitherto the date mechanisms in which the units and tens are displayed by two separate disks have had the essential, if not sole, goal of being able to enlarge the date numerals, the present invention shows that it is possible to gain another benefit from this type of mechanism for reducing corrections. Indeed, it may be seen from the foregoing description that this display system makes it possible to move on from "31" to "01" without causing the units disk to move, causing movement only of the tens disk.

FIGS. 7 to 11 show how this feature of the date mechanism described hitherto can be put to advantage in obtaining an annual date based on a novel concept whereby the date display changes entirely automatically from 01.03 to 28 or 29.02 of the next year, without either one of the disks or both of the two disks simultaneously ever moving by more than one step in 24 hours. As was seen earlier, the basic mechanism described earlier already allows the movement from "31" to "01" by changing only the tens disk by one step and by holding the units disk 1 immobile. All that is then required is to find a means of moving the two disks simultaneously by one step to move on from "30" to "01" and we shall then have a very simple annual date capable of implementing this clever date-change method and having all the advantages listed earlier.

This result is obtained by a method which consists in forming, in addition to the driveline which daily connects the clock movement with the units wheel 3 and, for every ten steps of the latter, to the tens pinion 4, via the peg 9 secured to this units wheel 3 and via the intermediate wheel 10, an annual driveline which connects the clock movement directly to the tens pinion 4 and is programmed to drive the latter by one step at the same time as the units wheel 3 to move on from "30" to "01" at the end of the thirty-day months.

This date mechanism is identical to the previous one except that it comprises an additional annual wheel 18 making it possible to form the annual driveline and except that the date finger 8 bears a stud 8*a* intended selectively to drive the annual wheel as will be explained hereinafter.

The annual wheel 18 has twenty-four teeth, namely two per month. Some of these teeth are thinned on the outside of a circular arc 18*a* concentric with the axis of this annual wheel 18, and others are not. The thickness of the thinned teeth of the annual wheel 18 is therefore reduced so as to allow these teeth to pass under the stud 8*a* of the date finger. The thickness of the two teeth 4*a* of the tens pinion 4 corresponding to numeral "0" extends over the entire thickness of the teeth of the annual wheel 18 so that these teeth are in a position to mesh with the teeth and the tens pinion 4. By contrast, the thickness of the other teeth of this tens pinion is reduced so that they do not meet the teeth of the annual wheel 18.

The teeth of the annual wheel 18 which are not thinned, are five in number and correspond to the five months of the year which have fewer than 31 days. In the figures relating to this annual date, every second tooth of the annual wheel is numbered according to the month of the year to which it and the tooth next to it corresponds, from 01 to January to 12 for December. As can be seen by virtue of this numbering, the un-thinned teeth of the annual wheel 18 correspond therefore to the months of February, April, June, September and November.

Figure 10:
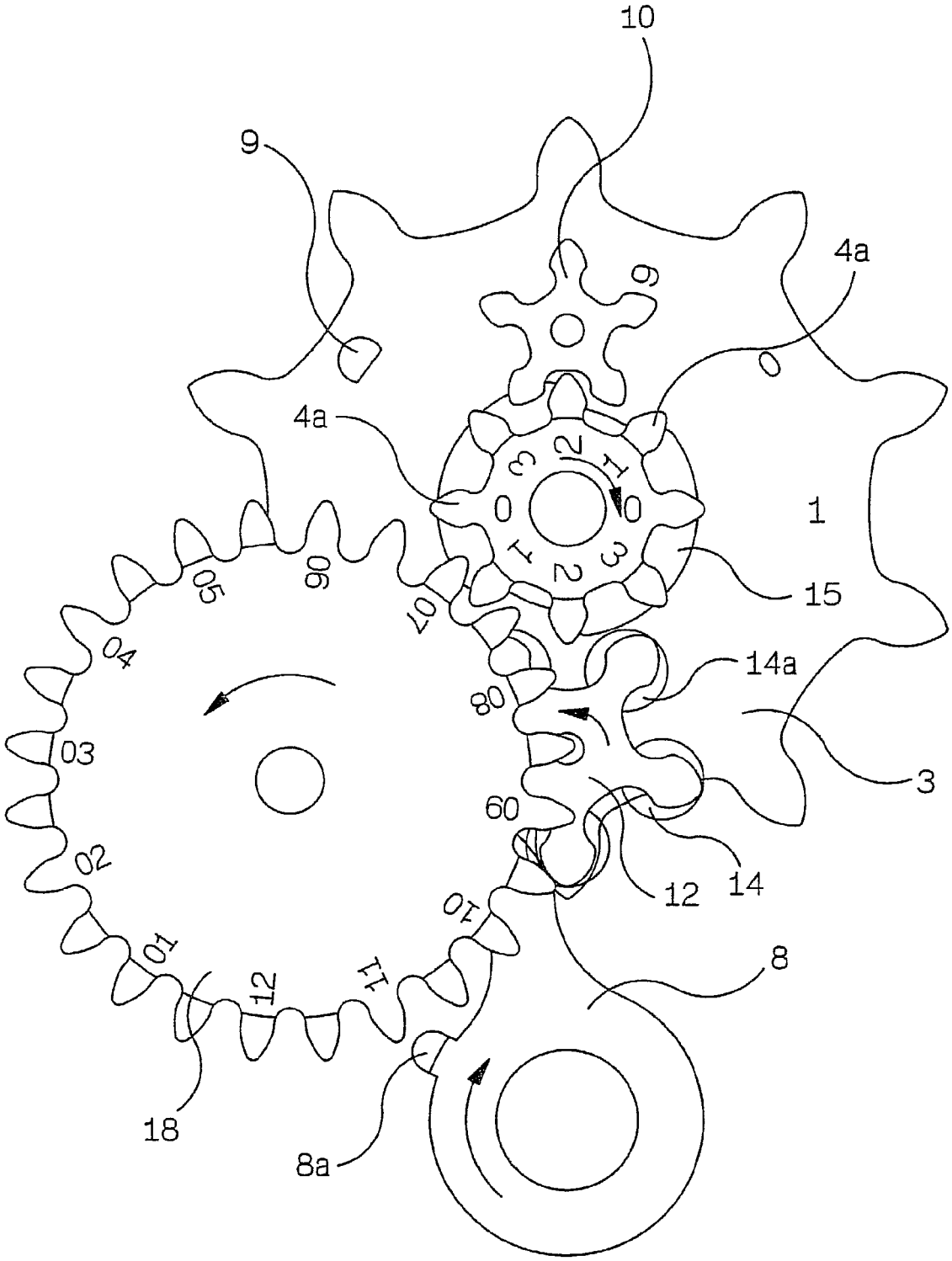

In order to understand how this annual date works, we shall first of all describe below, with the aid of FIGS. 7 to 10, the way in which this date mechanism works between 29.10 and 01.11, that is to say when moving on from the end of a 31-day month to the $1^{st}$ of the next month, then we shall describe, with the aid of FIGS. 10 and 11, how this date mechanism works between 30.11 and 01.12, that is to say when moving on from the end of a 30-day month to the $1^{st}$ of the next month.

If we look at the position of the runners of the date mechanism between 29.10 and 30.10 (FIGS. 7 and 8), we see that the date finger 8 has driven the units wheel 3 by one step and that the latter wheel has in turn driven the tens pinion 4, using the pin 9. Given that the tooth of the tens pinion 4 which meshes with the annual wheel 18 is the tooth "0" which is shaped to mesh with all the teeth of the annual wheel 18, the annual wheel is driven by one step.

To move on from 30.10 to 31.10 (FIGS. 8 and 9), the date finger 8 drives the units 3 by one step. The annual wheel 18 does not move the tooth corresponding to the month "10" as it is a thinned tooth which passes under the stud 8*a* of the date finger 8. It can also be seen that the next tooth on the units wheel 3 which will come into mesh with the date finger is in actual fact a tooth of the month-end pinion 12. Now, in the position illustrated by FIG. 9 and which corresponds to 31.10, it can be seen that, when the date finger 8 drives the tooth of this month-end pinion 12, this pinion is no longer prevented from turning by the cam 15, given that the roller 14 which normally butts against this cam 15 is facing a recess 15*a* in this cam.

The month-end pinion 12 can therefore rotate on itself without driving the units wheel 3, but by contrast driving the tens pinion 4 by one step, the tooth "0" of this pinion 4 engaged in the teeth of the annual wheel 18 once again driving this wheel 18 by one step. Thus, the date which previously displayed "31" has changed only the tens numeral, the units numeral having remained immobile, and the next date is therefore "01".

Figure 11:
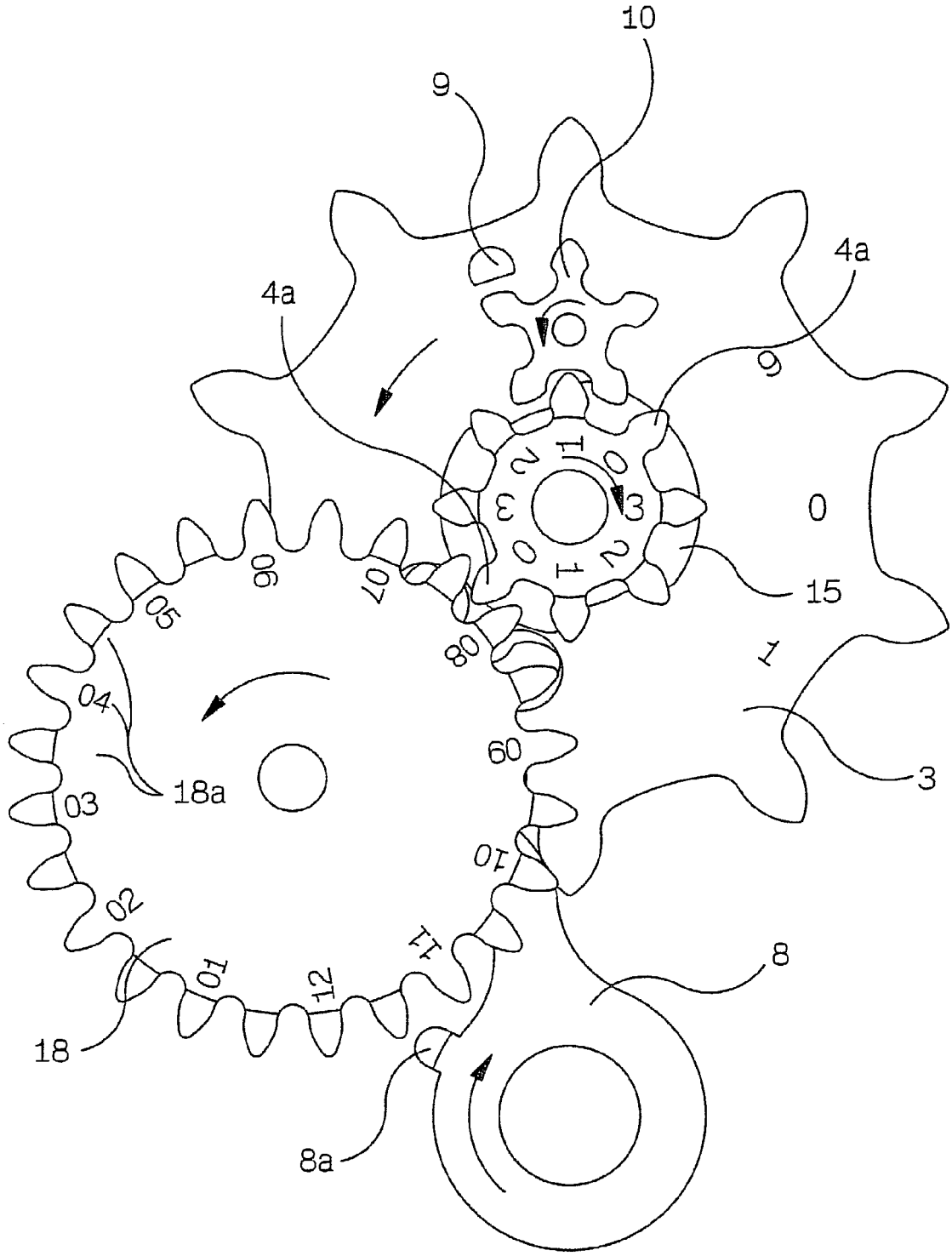
FIGS. 11 and 12 illustrate the positions of the runners of this same mechanism when the date moves on from "30" to "01".
Figure 12:
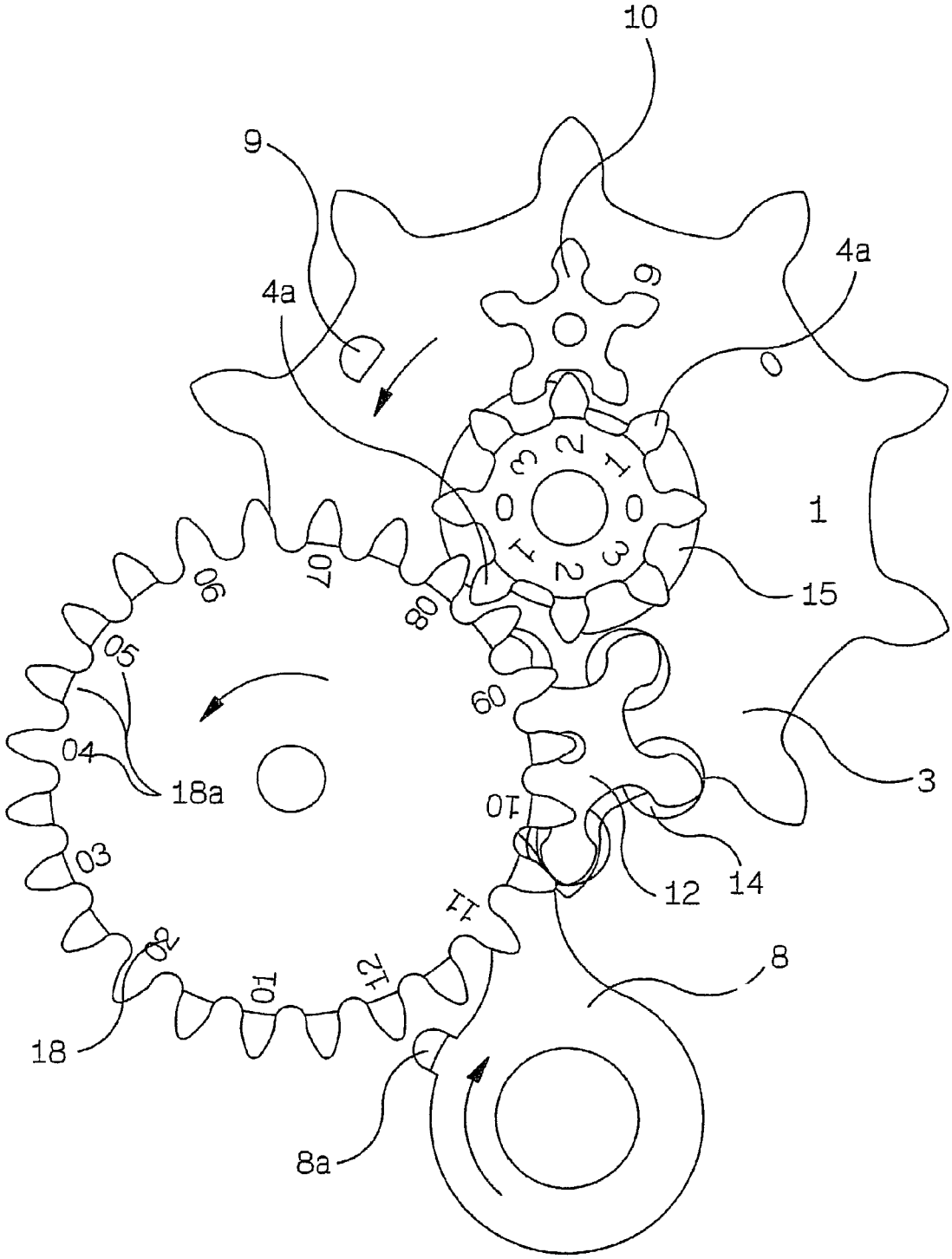

We shall refer to FIGS. 11 and 12 to see how to move on directly from "30" to "01", assuming that the tooth of the annual wheel which is in the path of the stud 8*a* is the tooth "11" corresponding to the end of the month of November. It is then with one of the five teeth of the annual wheel that the stud 8*a* is able to come into mesh.

When the date finger 8 turns from the position illustrated in FIG. 11 to move on to the position illustrated in FIG. 12, it drives the units wheel 3 by one step while the stud 8*a* at the same time drives the annual wheel 18 by one step also. Given that the tooth of the tens pinion 4 which is engaged in the teeth of the annual wheel corresponds to a tooth "0" shaped to mesh with all the teeth of the annual wheel 18, this tens pinion is therefore driven by one step by the annual wheel 18. Thus, the units numeral which was "0" moves on to "1" and the tens numeral which was "3" moves on to "0".

The date mechanism described hereinabove therefore allows movement automatically and without any correction from 01.03 to 28 or 29.02 of the next year.

What is claimed is:

1. A method for forming a date indicator actuated by a clock movement to show, in succession and automatically, all the days from 01.03 of one year to 28.02 of the next year, wherein the units and tens numerals arc placed onto respective indicator runners comprising ten numerals or a multiple of ten, and four numerals or a multiple of four numerals, respectively, two drivelines are formed, one being a daily driveline between said clock movement and said indicator runners, for moving the unites indicator runner selectively step by step by one step every 24 hours, and for moving the tens indictor runner by one step for every ten steps of the units indicator runner, in order to move on from one multiple of ten to the next, and for moving said tens indicator alone by one step to move on from "31" to "01" on a 31-day basic cycle, and an annual driveline between said clock movement and said tens indictor runner, which driveline is programmed to move the tens indicator runner by one step at the same time as the units indicator runner is moved by the daily driveline, to move on from "30" to "01" at the end of the months which comprise less than 31 days.

2. A date mechanism for the implementation of a method for forming a date indicator actuated by a clock movement to show, in succession and automatically, all the days from 01.03 of one year to 28.02 of the next year, wherein the units and tens numerals are placed onto respective indicator runners comprising ten numerals or a multiple of ten, and four numerals or a multiple of four numerals, respectively, two drivelines are formed, one being a daily driveline between said clock movement and said indicator runners, for moving the unites indicator runner selectively step by step by one step every 24 hours, and for moving the tens indictor runner by one step for every ten steps of the units indicator runner, in order to move on from one multiple of ten to the next, and for moving said tens indicator alone by one step to move on from "31" to "01" on a 31-day basic cycle, and an annual driveline between said clock movement and said tens indictor runner, which driveline is programmed to move the tens indicator runner by one step at the same time as the units indicator runner is moved by the daily driveline, to move on from "30" to "01" at the end of the months which comprise less than 31 days, in which said units indicator runner is secured to a unit indicator runner equipped with ten teeth or a multiple of ten teeth and said tens indicator runner is secured to a tens runner equipped with four teeth or with a multiple of four teeth, a transmission connecting the units and tens runners to move the latter runner by one step for every ten steps of the units runner and a drive runner for driving the units runner, connected to the indicator geartrain of the timepiece, wherein a tooth of the units runner for moving on from "1" to "2" is a tooth of an auxiliary runner the rotation spindle of which is secured to the units runner and is able to engage alternately with the teeth of the tens runner and with a cam coaxial with and secured to this tens runner, this cam comprising, on the one hand, a part for angularly immobilizing said auxiliary runner and, on the other hand, a cut-out the position of which is chosen to allow said auxiliary runner to drive said tens runner by one step between "31" and "01", and wherein said tens runner is shaped to engage selective with an annular runner itself selectively in engagement with said drive runner for driving the units runner, and said annual runner and said tens runner being in engagement, when the indicator runner moves the tens on from "2" to "3" and from "3" to "0", said drive runner for driving the units runner being shaped to engage with said annular runner only when the date moves on directly from "30" to "01".

3. The date mechanism as claimed in claim 2, in which the units runner and the tens runner are concentric and each carry a display disk, the surfaces of the two disks bearing the date numerals being coplanar.

4. The date mechanism as claimed in claim 2, in which all the runners are circular toothed members with a central axis of rotation.

5. The date mechanism as claimed in claim 2 in which the rubbing surfaces of said auxiliary runner with said cam consist of pivoting rollers associated with each tooth of said auxiliary runner.

6. The date mechanism as claimed in claim 2, in which said auxiliary runner is housed at least partly in a housing formed in the units wheel.

7. The date mechanism as claimed in claim 2, in which the selective engagement between the annual runner and, on the one hand, the tens runner and, on the other hand, the drive runner, is obtained by means of teeth of different thicknesses situated at different levels.

8. The date mechanism as claimed in claim 2, in which the tens and units numerals appear in a single window.

* * * * *